United States Patent [19]

Nazmy et al.

[11] Patent Number: 4,990,199

[45] Date of Patent: Feb. 5, 1991

[54] OXIDATION-RESISTANT AND CORROSION-RESISTANT HIGH-TEMPERATURE ALLOY FOR DIRECTIONAL SOLIDIFICATION ON THE BASIS OF AN INTERMETALLIC COMPOUND OF THE NICKEL ALUMINIDE TYPE

[75] Inventors: Maohamed Nazmy, Fislisbach; Markus Staubli, Dottikon, both of Switzerland

[73] Assignee: Asea Brown Boveri Ltd., Baden, Switzerland

[21] Appl. No.: 434,269

[22] Filed: Nov. 13, 1989

[30] Foreign Application Priority Data

Nov. 15, 1988 [CH] Switzerland ..... 4230/88

[51] Int. Cl.[5] ..... C22C 19/00

[52] U.S. Cl. ..... 148/429; 420/460

[58] Field of Search ..... 148/429, 409; 420/460

[56] References Cited

PUBLICATIONS

Nickel Aluminides for Structural Use, Journal of Metals, May 1986, pp. 19–21, C. T. Liu, et al.

The Role of Silicon in Corrosion-Resistant High Temperature Coatings, Thin Solid Films, vol. 95, 1982, pp. 3–20, H. W. Grunling, et al.

Ordered Alloys-Physical Metallurgy and Structural Applications, International Metals Review, 1984, vol. 29, No. 3, pp. 123–135, N. S. Stoloff.

Coatings Containing Chromium, Aluminum, and Silicon for High-Temperature Alloys, High Temperature Corrosion, National Association of Corrosion Engineers, Houston, Tex., San Diego, Calif., Mar. 2–6, 1981, pp. 604–614.

*Primary Examiner*—R. Dean

*Attorney, Agent, or Firm*—Oblon, Spivak, McClelland, Maier & Neustadt

[57] ABSTRACT

An oxidation-resistant and corrosion-resistant high-temperature alloy for directional solidification on the basis of an intermetallic compound of the nickel aluminide type having the following composition:

Al=10–16 atomic %
Si=0.5–8 atomic %
Ta=0.5–9 atomic %
Hf=0.1–2 atomic %
B=0.1–2 atomic %
Ni=the remainder The alloy has at least 90% by volume of the intermetallic phases $Ni_3Al$, $Ni_3Si$ and $Ni_3Ta$.

3 Claims, 1 Drawing Sheet

FIG.
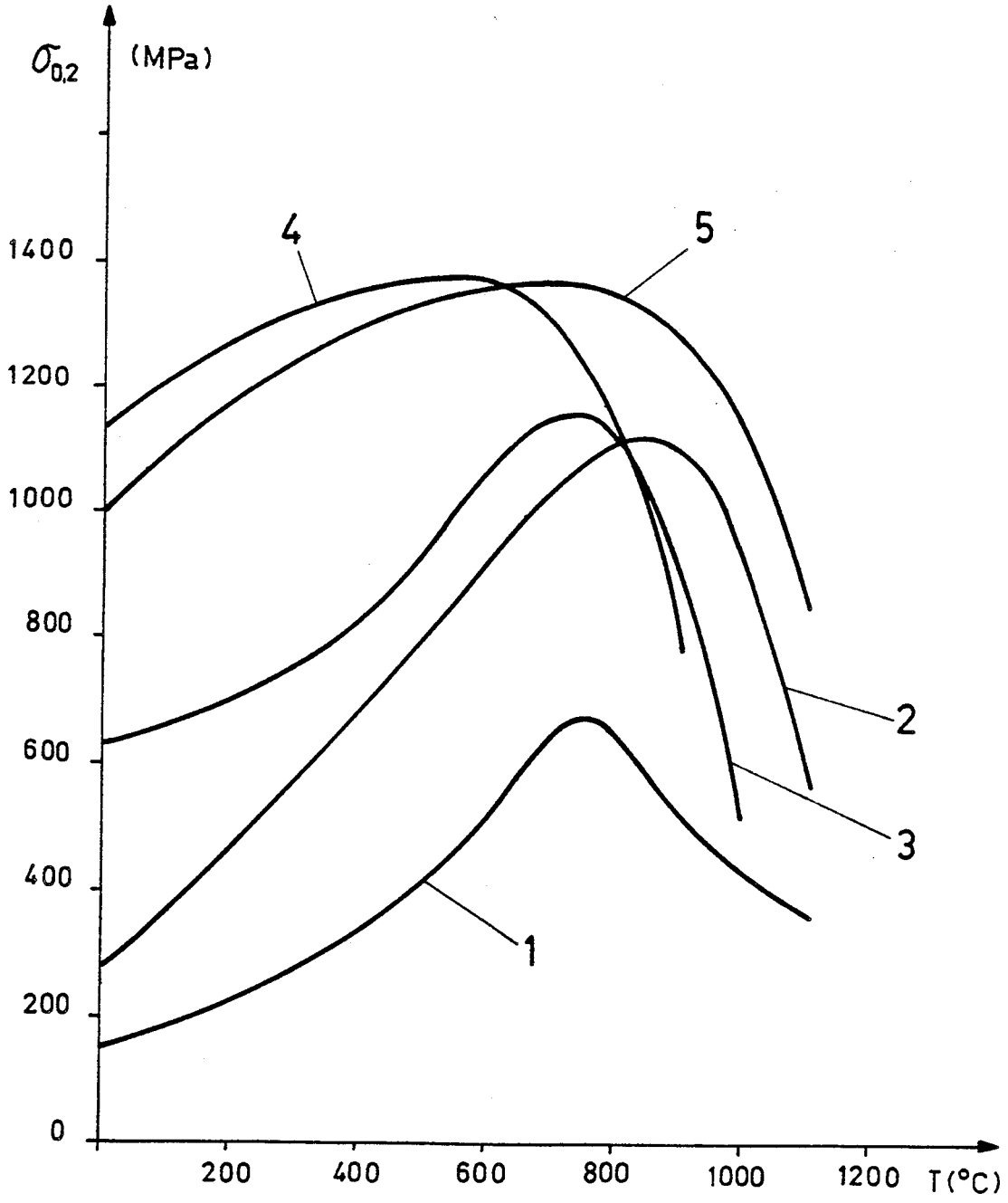

OXIDATION-RESISTANT AND CORROSION-RESISTANT HIGH-TEMPERATURE ALLOY FOR DIRECTIONAL SOLIDIFICATION ON THE BASIS OF AN INTERMETALLIC COMPOUND OF THE NICKEL ALUMINIDE TYPE

BACKGROUND OF THE INVENTION

1. Field of the Invention

High temperature alloys with high oxidation and corrosion resistance on the basis of intermetallic compounds which are suitable for directional solidification and supplement the conventional nickel-based superalloys.

The invention relates to the further development and improvement of the alloys based on the intermetallic compound $Ni_3Al$, having further additions increasing the thermal stability and the oxidation resistance.

In particular it relates to an oxidation-resistant and corrosion-resistant high-temperature alloy for directional solidification on the basis of an intermetallic compound of the nickel aluminide type.

2. Discussion of Background

The intermetallic compound $Ni_3Al$ has some interesting properties which make it appear attractive as a structural material in the average temperature range. This includes, inter alia, its low density compared with superalloys. However, its brittleness and its inadequate corrosion resistance stand in the way of its technical usability. The former can certainly be improved by additions of boron, in which case higher strength values are also achieved (cf. C.T.Liu et al, "Nickel Aluminides for structural use", Journal of Metals, May 1986, pp. 19–21). Nonetheless, this method, even while using high cooling rates, has not lead to any results which are useful in practice in the production of strip.

The corrosion resistance and oxidation resistance of alloys of this type based on $Ni_3Al$ can be improved by additions of silicon or chromium (cf. M. W. Grunling and R.Bauer, "The role of Silicon in corrosion resistant high temperature coatings", Thin Films, Vol. 95, 1982, pp. 3–20). In general, alloying with silicon is the more practicable method than that with chromium, since the intermetallic compound $Ni_3Si$ appearing at the same time can be fully mixed in $Ni_3Al$. This concerns isomorphous states, where no further undesirable phases are formed (cf. Shouichi Ochiai et al, "Alloying behaviour of $Ni_3Al$, $Ni_3Ga$, $Ni_3Si$ and $Ni_3Ge$", Acta Met. Vol. 32, No. 2, pp. 289, 1984).

However, the thermal stability of $Ni_3Al$ as well as of the above modified alloys is still inadequate, as follows from publications on intermetallic compounds (cf. N.S.Stoloff, "Ordered alloys-physical metallurgy and structural applications", International metals reviews, Vol. 29, No. 3, 1984, pp. 123–135).

It is known that, inter alia, silicon increases the corrosion resistance and oxidation resistance of surface layers forming protective oxides in coatings of high temperature alloys. This has been the subject of extensive investigations (cf. F. Fitzer and J. Schlichting, "Coatings containing chromium, aluminium, and silicon for high temperature alloys", High temperature corrosion, National association of corrosion engineers, Houston Texas, San Diego, Calif., Mar. 2–6, 1981, pp. 604–614).

In general, the properties of these known modified $Ni_3Al$ materials still do not meet the technical requirements in order to manufacture useful work pieces therefrom. This especially applies with regard to thermal stability and high-temperature corrosion resistance (resistance to sulfidation). There is therefore a need for materials of this type to be further developed and improved.

SUMMARY OF THE INVENTION

The object of the invention is to specify an alloy having a high oxidation and corrosion resistance, in particular against sulfidation at high temperatures, and at the same time high thermal stability in the temperature range from 400° to 800° C., which alloy is readily suitable for directional solidification and essentially consists of an intermetallic compound of the nickel aluminide type with further additions. The alloy is to have a high-temperature yield point of at least 1000 MPa in the temperature range of 400° to 800° C.

This object is achieved when the high-temperature alloy mentioned at the beginning has the following composition:

Al=10–16 atomic %
Si=0.5–8 atomic %
Ta=0.5–9 atomic %
Hf=0.1–2 atomic %
B=0.1–2 atomic %
Ni=the remainder and when it consists at least 90% by volume of a mixture of the intermetallic phases $Ni_3Al$, $Ni_3Si$ and $Ni_3Ta$.

DESCRIPTION OF THE PREFERRED EMBODIMENTS

The invention is described with reference to the following exemplary embodiments explained in greater detail by a Figure.

The Figure shows a graphic representation of the yield point as a function of the temperature for various alloys on the basis of an intermetallic compound of the nickel aluminide type.

The Figure relates to a representation of the yield point $\sigma_{0.2}$ (0.2% creep limit) in MPa as a function of the temperature T in %. The profile for the yield point of some known alloys is shown as a comparison. Curve 1 applies to the pure intermetallic compound $Ni_3Al$, i.e. an alloy with 25 atomic % Al; the remainder Ni. The yield point reaches a maximum of about 600 MPa at about 750° C. Curve 2 relates to an alloy with 22.4 atomic % Al, 10.5 atomic % Ti; the remainder Ni, i.e. $Ni_3Al$ which has been alloyed with about 10.5 atomic % Ti. The properties are clearly better. The high-temperature yield point reaches a maximum of about 1100 MPa at a temperature of about 850° C. If $Ni_3Al$ is alloyed with about 6 atomic % Nb, curve 3 is obtained. This corresponds to a composition of 23.5 atomic % Al; 6 atomic % Nb; the remainder Ni. The yield point maximum reaches the same value as with curve 2, but is at a slightly lower temperature of about 750° C. Curve 4 represents the profile for the yield point for a new alloy with 13.3 atomic % Al, 7 atomic % Si; 3 atomic % Ta, the remainder Ni. It reaches a maximum of over 1300 MPa at a temperature of about 550° C. Its value never drops below 1000 MPa in the temperature range of interest from room temperature to 800° C. Curve 5 relates to a new alloy with 15.4 atomic % Al; 1 atomic % Si; 7 atomic % Ti; the remainder Ni. The yield point maximum reaches a value of over 1300 MPa at a temperature of about 700° C. Values of at least 1000 MPa are reached in the range from room temperature to about 1000° C.

EXEMPLARY EMBODIMENT 1:

An alloy of the following composition was melted in the vacuum furnace :

Al=13.3 atomic %
Si=7 atomic %
Ta=3 atomic %
Hf=0.5 atomic %
B=0.2 atomic %
Ni=the remainder The melt was cast into a casting blank about 120 mm in diameter and about 120 mm high. The blank was remelted under vacuum and forced to solidify in a directional manner under vacuum in the form of bars about 12 mm in diameter and about 120 mm long.

The bars were directly worked into tensile test pieces without subsequent heat treatment. The tensile strength values thus achieved as a function of the test temperature are reproduced in curve 4.

Further improvement in the mechanical properties by suitable heat treatment is within the bounds of possibility.

EXEMPLARY EMBODIMENT 2:

Like example 1, the following alloy was melted under vacuum:

Al=15.4 atomic %
Si=1 atomic %
Ta=7 atomic %
Hf=0.5 atomic %
B=0.1 atomic %
Ni=the remainder The melt was cast like exemplary embodiment 1, remelted under vacuum and forced to solidify in a directional manner in bar form. The directional solidifying and the dimensioning of the bars corresponded to exemplary embodiment 1. The bars were directly worked into tensile test pieces without subsequent heat treatment. The yield point values thus achieved as a function of the test temperature corresponded to curve 5. These values can be further improved by heat treatment.

The invention is not restricted to the exemplary embodiments. In principle, the oxidation-resistant and corrosion-resistant high-temperature alloy for directional solidification on the basis of an intermetallic compound of the nickel aluminide type has the following composition:

Al=10–16 atomic %
Si=0.5–8 atomic %
Ta=0.5–9 atomic %
Hf=0.1–2 atomic %
B=0.1–2 atomic %
Ni=the remainder.

It contains at least 90% by volume of a mixture of the intermetallic phases $Ni_3Al$, $Ni_3Si$ and $Ni_3Ta$. The Si has a favourable effect on the high-temperature corrosion resistance especially in the face of sulfur, while the Ta further increases the thermal stability and shifts its maximum towards higher temperatures.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. An oxidation-resistant and corrosion-resistant high-temperature alloy for directional solidification based on an intermetallic compound of the nickel aluminide type consisting essentially of Al=10–16 atomic %
Si=0.5–8 atomic %
Ta=0.5–9 atomic %
HF=0.1–2 atomic %
B=0.1–2 atomic %
Ni=the remainder and consisting at least of 90% by volume of a mixture of the intermetallic phases $Ni_3Al$, $Ni_3Si$ and $Ni_3Ta$.

2. The high-temperature alloy as claimed in claim 1 consisting of

Al=13.3 atomic %
Si=7 atomic %
Ta=3 atomic %
Hf=0.5 atomic %
B=0.2 atomic %
Ni=the remainder.

3. The high-temperature alloy as claimed in claim 1 consisting of

Al=15.4 atomic %
Si=1 atomic %
Ta=7 atomic %
Hf=0.5 atomic %
B=0.1 atomic %
Ni=the remainder.

* * * * *